US009427623B2

(12) United States Patent
Gennario, Jr.

(10) Patent No.: US 9,427,623 B2
(45) Date of Patent: Aug. 30, 2016

(54) SENSOR INTEGRATED SPORTS EDUCATION

(71) Applicant: Carlo Gennario, Jr., Baldwinsville, NY (US)

(72) Inventor: Carlo Gennario, Jr., Baldwinsville, NY (US)

( * ) Notice: Subject to any disclaimer, the term of this patent is extended or adjusted under 35 U.S.C. 154(b) by 13 days.

(21) Appl. No.: 14/100,441

(22) Filed: Dec. 9, 2013

(65) Prior Publication Data

US 2015/0157917 A1 Jun. 11, 2015

Related U.S. Application Data

(60) Provisional application No. 61/763,079, filed on Feb. 11, 2013.

(51) Int. Cl.

| | |
|---|---|
| ***A63B 71/06*** | (2006.01) |
| ***A63B 24/00*** | (2006.01) |
| ***A42B 3/04*** | (2006.01) |
| *A41D 1/00* | (2006.01) |
| *A63B 71/12* | (2006.01) |

(52) U.S. Cl.

CPC ..... *A63B 24/0062* (2013.01); *A42B 3/0433* (2013.01); *A63B 71/0622* (2013.01); *A63B 71/12* (2013.01); *A41D 1/002* (2013.01); *A63B 2024/0081* (2013.01); *A63B 2071/0625* (2013.01); *A63B 2071/0683* (2013.01); *A63B 2071/1208* (2013.01); *A63B 2207/02* (2013.01); *A63B 2209/10* (2013.01); *A63B 2220/56* (2013.01); *A63B 2220/801* (2013.01); *A63B 2220/803* (2013.01); *A63B 2220/836* (2013.01); *A63B 2225/50* (2013.01)

(58) Field of Classification Search

CPC ..... A63B 69/00; A63B 69/04; A63B 71/08; A63B 2220/50–2220/54; A63B 2220/56; A63B 71/06; A41D 13/0512; A41D 13/0506

See application file for complete search history.

(56) References Cited

U.S. PATENT DOCUMENTS

| | | | | |
|---|---|---|---|---|
| 4,824,107 | A | 4/1989 | French | |
| 5,184,831 | A | 2/1993 | Garner | |
| 5,546,609 | A | 8/1996 | Rush, III | |
| 5,553,860 | A | 9/1996 | Zelikovich | |
| 5,636,378 | A | 6/1997 | Griffith | |
| 6,033,370 | A | 3/2000 | Reinbold et al. | |
| 6,700,051 | B2 | 3/2004 | Aldridge | |
| 7,384,380 | B2 | 6/2008 | Reinbold et al. | |
| 7,516,643 | B2 | 4/2009 | Valentini | |
| 7,891,231 | B2 | 2/2011 | Song | |
| 8,079,247 | B2 | 12/2011 | Russell et al. | |
| 8,221,291 | B1 | 7/2012 | Kantarevic | |
| 9,096,174 | B1 * | 8/2015 | Banks | B60Q 1/34 |
| 2002/0037759 | A1 * | 3/2002 | Aldridge | 463/1 |
| 2002/0077223 | A1 * | 6/2002 | Zai | 482/83 |
| 2003/0217582 | A1 * | 11/2003 | Reinbold et al. | 73/12.09 |
| 2009/0000377 | A1 | 1/2009 | Shipps et al. | |
| 2009/0176632 | A1 * | 7/2009 | Wiber | 482/84 |
| 2009/0235761 | A1 * | 9/2009 | Song | 73/862.59 |
| 2012/0144934 | A1 | 6/2012 | Russell et al. | |
| 2012/0214647 | A1 * | 8/2012 | Ji et al. | 482/8 |

* cited by examiner

*Primary Examiner* — Jasson Yoo

(74) *Attorney, Agent, or Firm* — Barclay Damon, LLP

(57) ABSTRACT

A sports training system and method comprising sensors, capable of detecting contact, disposed in selected locations of athletic equipment worn by a player. A processor communicates with the sensors, for receiving contact data from the sensors, and with an output device communicatively connected to the processor for outputting an audible or visually detectable signal in response to the contact detected by the sensors.

15 Claims, 6 Drawing Sheets

300

500

| 801 Player Name | 802 Time Period | 803 Coach Name | 804 Injury | 805 Contacts Detected | 806 Contacts Correct | 807 Performance % | 808 Position |
|---|---|---|---|---|---|---|---|
| | | | | | | | |
| | | | | | | | |
| | | | | | | | |

SENSOR INTEGRATED SPORTS EDUCATION

CROSS-REFERENCE TO RELATED APPLICATIONS

This applications claims the benefit of the priority date of U.S. Provisional Patent Application Ser. No. 61/763,079 filed Feb. 11, 2013, the entire contents, teachings and specification of which is incorporated herein by reference in its entirety.

BACKGROUND OF THE INVENTION

The subject matter disclosed herein relates to sports training equipment and, in particular, to a system and method for training players in proper physical contact techniques such as used when blocking, tackling, sliding, or checking.

There has been an increasing awareness of sports injuries experienced by players participating in contact sports. Concussions and other impact injuries involving a player's head are of particular concern. Forensic studies implicate head impacts, and concussions caused thereby, as particularly causative in brain associated injuries. Many sports governing authorities have taken precautions by enacting rules that limit players' ability to make contact with opponents during games in a manner that puts a player's head at risk. Several states have enacted laws requiring high school athletes who exhibit concussion symptoms to be immediately removed from sports activity. Oftentimes, the risk of injury increases for the attacking player as well as for the targeted opponent if an improper technique is executed by the attacking player.

Players who have become accustomed to participating in athletic contests in a particular manner have found it difficult to adjust their contact techniques to new rules that are designed to limit player head injuries. This is because the new rules require that players change long instilled habits in order to comply with a changing rules regime. What is needed is a system and coaching method that instills in young players habits that are in accord with safe contact techniques. These techniques require training to improve skills in the areas of blocking, tackling, checking, sliding, or being blocked, tackled, or checked.

Published studies have shown that many high impact hits occur during team practice sessions. As a result, some organizations limit the amount of contact that takes place during practice. Others have enlisted training for coaches and instructors so that they can be more aware of, and better understand, concussion symptoms and potential harmful effects resulting from concussions. Another approach is to spend more time coaching players in proper and safe contact techniques.

BRIEF DESCRIPTION OF THE INVENTION

Learning techniques differ with every individual. Individual student athletes may each learn better via one of audio, visual or kinesthetic modes. Using embodiments of the present invention, a coach or instructor is able to cover all three modes during their instruction. The student, as well as the instructor, may also receive automatic audio and visual feedback. While learning an activity, students naturally use an audio mode when listening to instruction. A visual learning mode may be exercised by having position patches, described below, attached to athletic uniforms, garments, jerseys, and/or athletic equipment that is worn by a player. The kinesthetic mode may be exercised when the student physically performs (practices) the athletic activity. Embodiments disclosed herein may provide feedback to coaches and/or players using an audio tone and/or light sources being illuminated via programmed electronics.

The goal is to have the student athlete become more cognitively aware of his or her physical activity and correct body posture that the instructor is teaching. Embodiments described herein enable the instructor to better teach the student where and how the instructor wants the student to make contact with another athlete or with practice equipment, such as a tackling dummy. The sensor patches as described herein are attachable to a jersey, another garment, or a combination thereof, worn by the athlete, or the sensor patches may be attached to athletic equipment. When proper contact is made to specific areas, sensors become activated and provide sensory feedback. The training patches may be attached permanently or temporarily to the garment and/or equipment. Sensors integrated into the pads may emit a tone to provide the athlete and/or coach direct feedback that the action was performed properly. A light located within the sensor or protective pad area may become illuminated as another means to provide the athlete and/or the coach/instructor direct visual feedback that the athlete properly performed the physical action or activity.

Embodiments of the present invention could be attached to a jersey, a garment, or on an athlete's protective pads using, for example, a hook-and-loop type fastener such as distributed by Velcro USA, Inc. of Manchester, N.H. Although particular fastening means may be described herein as exemplary embodiments, other means of attachment are considered within the scope of the present invention. For example, snaps, buttons, stitching, sewing, adhering, enclosing within embedded pockets, and other suitable attachment means and apparatuses are envisioned. Sensors attached to specific areas on a player's body may be used to teach the student proper tackling techniques. For example, a sensor near the top of the back of the jersey may communicate with another sensor located on the back of the player's helmet to detect whether the player's head is in a proper, upward position during an impact with another player or with a piece of practice equipment. This detection could be used to activate other sensors worn by the player, such as the shoulder pad sensors. Together, these devices would verify that the player both has his or her head up and is properly striking, for example, another player, a training bag or a tackling dummy using the shoulder pads. The sensors may become activated to illuminate a light source, or emit a tone, or a combination thereof, verifying that the drill was performed properly. Alternatively, the sensors may become activated to illuminate a light source, or emit a tone, or a combination thereof, to indicate that the drill was performed incorrectly. Having the student athlete learn proper tackling techniques reduces the possibility of injuries. Having the proper form and regulating players' movement with the sensors instructs the athlete as to proper form during a practice session. In one embodiment, emphasis on using the shoulder pads, not the helmet, when making contact between opposing players will, in turn, reduce the probability of head injuries.

Embodiments of the Sensor Integrated Sports Education (SISE) system disclosed herein may be used in many different sports activities. Actions by the player which triggers sensor detections and sensor outputs may be documented by directly storing data in an electronic memory or by wirelessly transmitting data to be recorded for later review, and for customizing player instruction. The data may be stored or archived to provide a lifetime training history for any particular player. In some embodiments, sensors can be attached directly to the athlete's body to verify proper form and contact area. Additional sensors, either pre-programmed or wirelessly programmable, can be strategically located on athletic equipment or other garments in order to verify that proper form is being followed. The sensors may each be programmed to activate or deactivate other sensors depending on desired activity sequences.

A sports training system and method comprising sensors, capable of detecting contact, disposed in selected locations of athletic equipment or garments worn by a player is disclosed. A processor communicates with the sensors, for receiving contact data from the sensors, and with an output device communicatively connected to the processor for outputting an electric signal thereto in response to the contact detected by the sensors. The output device is activated and provides human discernable visual, tactile, and/or audio feedback. An advantage that may be realized in the practice of some disclosed embodiments of the sensor integrated sports training system is improved safety for players, especially younger players, participating in contact sports.

In one exemplary embodiment, a sports training system is disclosed. The sports training system comprises a sensor, which is capable of detecting contact, that is placed in a selected location of athletic equipment or an athletic garment worn by a player, or in standalone practice equipment. A processor in communication with the sensor is disposed together with the sensor or in another selected location of the athletic equipment or garment worn by the player. When the sensor detects contact it transmits an electric signal to the processor, another sensor, or both, indicating that the contact was detected. An output device connected to the processor provides a human discernable audible, visual or tactile feedback to the player or coach, or both, in response to the contact detected by the sensor. Strategic placement of the sensors proximate to safe contact areas of athletic equipment or a garment may be used to verify correct contact techniques.

In another exemplary embodiment, the sports training system comprises a plurality of sensors capable of sensing contact disposed in selected locations of athletic equipment, such as a tackling dummy, or a garment worn by a player. A processor in communication with the plurality of sensors receives data from the sensors indicating that a contact was detected, and controls operation of the sensors. The processor is also disposed in a selected location of the athletic equipment or garment and is connected to an output device for controlling the output of an electric signal in response to contact sensed by the sensors. The output device provides a human discernable audible, visual or tactile feedback to the player or a coach, or both, in response to the contact detected by any of the sensors. The processor may also be coupled to an electronic memory device for recording and accumulating data representing the detected contacts. Such data may be recorded, stored, and archived for later review by coaches such as to modify training instruction so as to improve a player's techniques. Such data may also be stored as a training history of a particular player's lifetime practice sessions to determine correlations as between training techniques and resulting improvements in a player's performance, for example. Such data may also be used to record and track injuries suffered by a particular player. Such data may be aggregated to record and track performance and injuries for groups of players. Such data may be stored in association with various identifying data, such as date, time and place of training/practice, the player's name, the name of the player's coach, and other pertinent data that may be used to correlate performance and possibly a particular player's injury with the associated data. For example, it may be determined that some players do not perform well during morning practice sessions as compared to evening practice sessions. As another example, it may be determined that particular tackling techniques result in an increased incidence of injury for a particular player or for a group of players. As yet another example, such data may be used to track performance or injury rates for a particular coach or for a particular training exercise. Various other correlations may be uncovered as the accumulated data is analyzed.

In another exemplary embodiment, a method of training athletes is disclosed. The method comprises the steps of placing contact sensors, which are communicatively connected to audible, visual, or tactile based output devices, or a combination thereof, on selected areas of a player's sporting equipment, garments, or on the player's body. The player is directed by a coach or by other instruction to proceed in a sporting manner that requires physical contact against a practice opponent or against a piece of practice equipment, such as a tackling dummy. The coach and/or player observes indications from the output device or devices, or a recording device records the indications for later observation, generated by the contact sensors indicating whether the physical contact technique exercised by the player was properly executed. The coach directs the player, or the player may be directed by written or otherwise recorded instructions, to modify the physical contact technique in response to the negative indications from the audible, visual, or tactile based output devices that the physical contact technique was improper. If the contact techniques exercised by the player are proper and correct as indicated by the positive outputs of the audible, visual, or tactile based output devices then the player is not directed to modify his or her contact technique. Thus, the audio, visual, or other, outputs may be programmed to provide audio/visual signals when correct techniques are detected or, in another embodiment, when incorrect contact techniques are exercised. In another embodiment, different output tones and/or colors of light sources may be programmably selected to indicate both proper and improper contact techniques, thereby providing immediate positive and negative feedback to the players and/or coaches.

In another exemplary embodiment, a method of monitoring players during an athletic event between multiplayer teams participating on a playing field or arena is disclosed. The method comprising placing contact sensors, which are communicatively connected to audible, visual, or tactile based output devices, or a combination thereof, on selected areas of a players' sporting equipment, garments, or on their bodies. The athletic event is then staged on a playing field or arena during which players on opposing teams proceed in a sporting manner that causes physical contact at least between the players on the opposing teams. The contact sensors transmit electric signals indicating that contact has been detected, and the output devices receiving the signals provide the audible, visual, or tactile output indicating whether the detected physical contact was caused by any player in an impermissible manner. If so, the next step includes penalizing the player, or his or her team, who caused the impermissible physical contact.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

Other embodiments that are contemplated by the present invention include a computer program product, readable storage medium, computer readable media, and program storage devices tangibly embodying or carrying a program of instructions, or storing computer programs, readable by machine or a processor, for having the machine or computer processor execute instructions or data structures stored thereon. Such computer readable media can be any available media that can be accessed by a general purpose or special purpose computer. Such computer-readable media can comprise physical computer-readable media such as RAM, ROM, EEPROM, and other solid state electronic storage devices, and CD-ROM, DVD, or other optical storage media such as optical disk storage, optical tape, machine readable bar codes, or magnetic storage media such as magnetic disk storage (such as a floppy disk), magnetic tape, or other magnetic storage devices, for example. Any other media or physical device that can be used to carry or store software programs which can be accessed by a general purpose or special purpose computer, controller, processing chip, or a circuit board with or without processing chips or chip sets are considered within the scope of the present invention.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale neither with respect to relative size, angular relationship, or relative position nor to any combinational relationship with respect to interchangeability, substitution, or representation of an actual implementation.

BRIEF DESCRIPTION OF THE DRAWINGS

The drawings illustrate only certain embodiments of this invention and are therefore not to be considered limiting of its scope, for the scope of the invention encompasses other equally effective embodiments. Thus, for further understanding of the invention, reference can be made to the following detailed description, read in connection with the drawings in which.

DETAILED DESCRIPTION OF THE INVENTION

The following detailed description should be read with reference to the drawings, in which like elements in different drawings are identically numbered. The drawings, which are not necessarily to scale, depict selected embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention.

As used herein, the terms "student", "athlete", or "player" refers to any human subject. The term "about" as used in connection with a numerical value throughout the description and claims denotes an interval of accuracy, familiar and acceptable to a person skilled in the art. The interval governing this term is preferably about ±10%. Unless specified, the terms described above are not intended to narrow the scope of the invention as described herein and according to the claims. The term "equipment" refers to any garment or any protective or athletic equipment worn by a player inclusive of, but not limited to, jerseys, uniforms, shorts, shirts, hats, cleated and uncleated footwear, skates, and pants; padding such as a shoulder pad, a hip pad, a shin pad, an elbow pad, a thigh pad, a knee pad, or padded gloves; rigid equipment such as a helmet, a visor, shoulder pads, hip pads, a shin guard, an elbow guard, thigh pads, a knee pad; or to playing equipment. Moreover, the equipment may be related to any sport wherein players may intentionally or unintentionally make physical contact with another player.

Figure 1A:
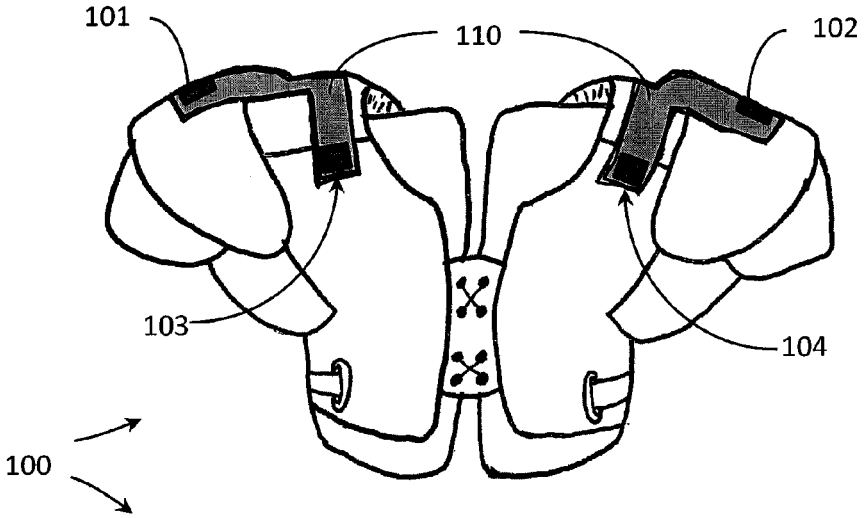
FIG. 1A illustrates a portion of an exemplary sensor integrated sports training system as viewed toward the front of protective pads.
Figure 1B:
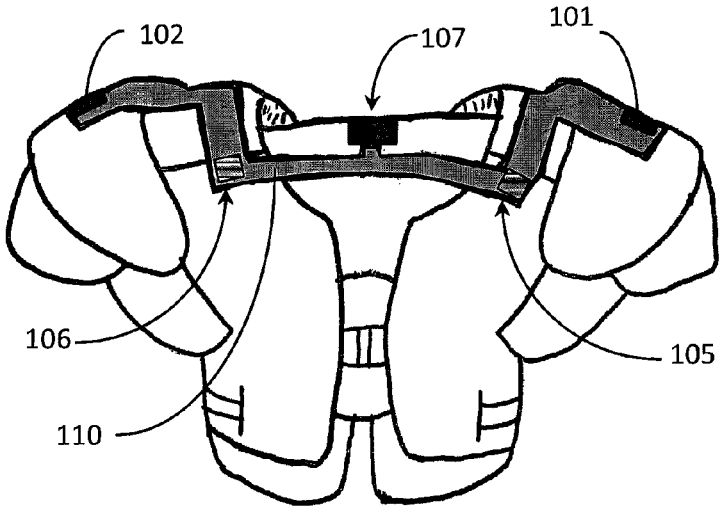
FIG. 1B illustrates a portion of an exemplary sensor integrated sports training system as viewed toward the back of the protective pads of FIG. 1A.
Figure 1C:
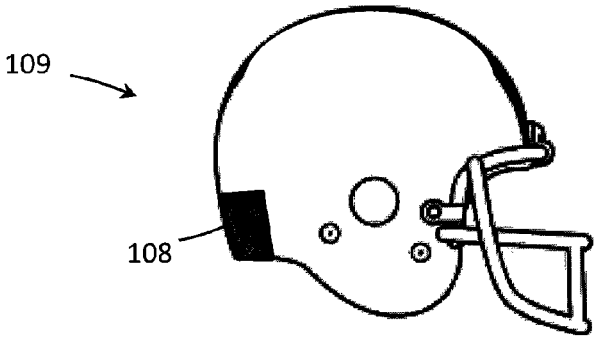
FIG. 1C illustrates a portion of an exemplary sensor integrated sports training system on a helmet.

As illustrated in FIGS. 1A-C there is shown an embodiment of a sensor integrated sports education system as implemented in protective pads 100 such as shoulder pads, and a helmet 109. The sensors 101, 102, 103, and 104 are attached to protective pads 100 at particular contact target zones as follows, a right side sensor 101 is attached to protective pads to be worn proximate a player's right shoulder; a left side sensor 102 is attached to protective pads to be worn proximate a player's left shoulder; a right front sensor 103 is attached to protective pads to be worn proximate a player's upper right chest area; a left front sensor 104 is attached to protective pads to be worn proximate a player's upper left chest area. The sensors 101-104 being attached to protective pads 100 as illustrated are not limited to being attached to shoulder pads, and may be attached to any athletic equipment considered as necessary to detect impact for determining playing performance and designing safer playing techniques.

The sensors are pressure sensitive sensors and are activated to output an electric signal when detecting a sufficient pressure. These areas, where the sensors are located, represent target contact zones where physical contact between opposing players can be made safely. When any sensor detects contact it communicates an electric signal to processors 105 or 106 as follows: when either of sensors 101, 102 detects contact it sends an electric signal to processor 105 and when either of sensors 103, 104 detects contact it sends an electric signal to processor 106. Processors 105 and 106 are attached to portions of the protective pads 100 proximate to a player's back. It should be noted that the number of sensors used in any training regime can include one or more sensors. The sensor, or sensors, may be placed in any area of a player's equipment deemed important by coaches and appropriate for contact training. The number of processors may include one or more processors programmed to apply the methods disclosed herein.

A helmet sensor 108 is attached to helmet 109 proximate a bottom of the helmet in the back, which cooperates with proximity sensor 107 disposed at the upper back area of protective pads 100 to activate the sensor integrated sports education system as described below. It should be noted that the attachment locations for the pressure sensors can vary for a variety of reasons. Such reasons may include that the sensor integrated sports education system is used for different sports wherein different target zones are important during training and practice.

In one embodiment, the sensors are pressure sensors which can be programmed to selected levels of sensitivity so that any level of impact can be set as a threshold in order for the sensor to respond by sending an electric signal to a processor or to another sensor connected thereto by wire or wirelessly. Once detected, the sensor transmits the electric signal to the processor which can be programmed to activate a speaker such as a piezo buzzer, an illumination feature such as an LED or a number of LEDs, or a tactile pressure pad which is felt by the player. The tactile pressure pad may have a moving part that increases a contact pressure on the player's body which is felt by the player. The activation can occur using output devices placed on the player's equipment, uniform, on the player's body, or contained within the packaging used for the sensors and processors. These devices are designed so that the player receives immediate feedback when a sensor detects contact. The player can receive feedback in the form of an audible sound if a speaker is used as the (output) feedback device, or in the form of a visual indicator if an illumination device is used as the (output) feedback device, or in the form of a tactile signal on the player's skin if a tactile pressure pad is used as the (output) feedback device, or the feedback device can encompass any combination of these sensory output devices.

The feedback activation can also occur in remote devices with which the processors may communicate wirelessly. In these device examples, a coach or other trainer may receive audible, visual, or tactile feedback in a device proximate to the coach or trainer. The device can include a hand held processing device such as a tablet computer, or other hand-held device such as a cell phone or PDA. It may also include a computer station for advanced processing of the detected contact data transmitted by the processors. Such advanced processing may include time and date recording, logging of contact areas and magnitude of impact force, as well as the identities of players causing impacts and receiving impacts. The data can be correlated with reported injuries and accumulated over time to enable statistical investigation such as regression analysis of the data to uncover causative relationships between injury and training methods. More complex processor/sensor systems may be tagged with player IDs enabling recording and correlation of all detected data with a corresponding player. Team training may be modified based on findings in such accumulated data.

In one embodiment, a sensor 108 may be attached, for example, to the back of the helmet 109 which activates the sensor integrated training system when the player's head is held in an upright position, as follows. A companion proximity sensor/activator 107 is placed on the back of the player's uniform near the top of the jersey proximate the player's neck. When the sensor 108 on the back of the player's helmet approaches the proximity sensor/activator on the back of the player's jersey, the proximity sensor/activator activates the sensor integrated training system to detect an impact. The helmet sensor 108 approaches the proximity sensor 107 in a situation wherein a player has assumed a position where the player's torso leans forward and the player's head is held in a proper upright position and ready for making contact with an opponent or a practice tackling dummy. If the player's head is not held in an upright, proper, and safe position for contact with an opponent or with the tackling dummy, the sensors 107, 108 will not be brought into sufficient proximity and will not activate the sensor integrated training system and any contact made by the player will not result in a positive audio or visual feedback signal. An example improper contact technique involves a player using the top of his or her helmet to make contact against an opponent or tackling dummy. In an activated state, the sensor output system will output an audible, visual, or tactile signal that the player, or the player's coaches, can hear, see, or feel, respectively, or a combination thereof. The audio or visual signal can be used to indicate that a successful proper contact technique has been executed or it can be used to indicate that an improper contact technique has been made, or a combination of both. The programmability of the sensor integrated sports education system provides flexibility that can be tailored to individual coaching preferences.

Figure 2:
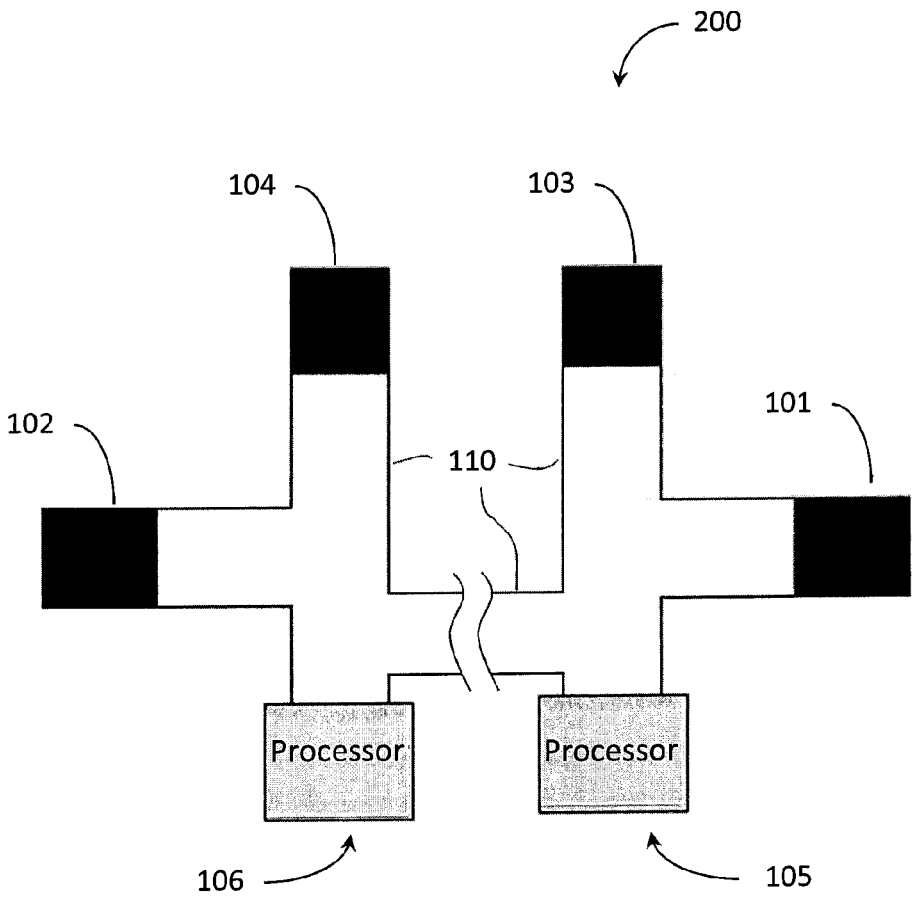
FIG. 2 illustrates exemplary packaging for attaching and securing electronics used in the integrated sports training system.

With reference to FIG. 2, there is illustrated a packaging for securing the aforementioned sensors and processors and their electrical interconnections. In one embodiment, sensors 101, 102, 103, and 104 are electrically connected to processors 105, 106 by wired connection or wirelessly. In another embodiment, sensors 101 and 103 are electrically connected to processor 105, by wired connection or wirelessly, while sensors 102 and 104 are electrically connected to processor 106, by wired connection or wirelessly. In another embodiment, only one sensor or only one processor may be used. These electronic devices can be enclosed in a flexible plastic or rubberized sleeve 110, such as Neoprene, for example, which secures the electronic devices in relative positions as shown. One surface of the sleeve 110 may comprise adhesive or other means, such as hook-and-loop fasteners, for temporarily securing the sleeve together with its contained electronic devices to a player's protective pads 100 or to a player's uniform. In one embodiment, the sleeve 110 and its contained electronics may be permanently attached to protective pads 100 as an add-on, they may be built-in during manufacture of the protective pads 100, or they may be temporarily attached using adhesive hook-and-loop fasteners. Other attachment methods may be employed and are considered within the scope of the present invention. As described above, for example, snaps, buttons, stitching, sewing, adhesives of various kinds, or enclosing within embedded pockets and other suitable attachment apparatuses are envisioned. As such, the processors and sensors described herein may be individually secured within protective pads 100 using flexible plastic or rubberized pockets and communicating by electric wires connected therebetween or wirelessly using radio frequency transmission circuits connected thereto. For example, a wireless transceiver circuit may be compatible with the near field communication ("NFC") standard and is configured to establish radio communication with, for example, another NFC compliant device in proximity thereto to initiate a wireless data exchange therewith.

As shown in FIGS. 1A-B and 2, the sleeve 110 secures the electronic devices in a spatial relationship such that the devices can be attached to the protective pads 100 as shown in FIGS. 1A-B, with the sensors 101, 102 held in proximity to a player's shoulders, sensors 103, 104 held in proximity to a player's upper chest area, and processors 105, 106 held in proximity to a player's back, and sensor 107 proximate the player's upper back, as described above in relation to FIGS. 1A-B. The sleeve also serves to protect the electronic devices from detrimental effects of moisture such as from inclement outdoor weather or from perspiration. The sleeve 110 may also comprise means, such as a permanent adhesive or means for sewing the sleeve and electronic devices into the fabric of a player's jersey or other athletic equipment, for permanently or temporarily securing itself and its contained electronic devices to the protective pads 100 or to other athletic equipment. Various means of attachment may be employed as described above.

Figure 3:
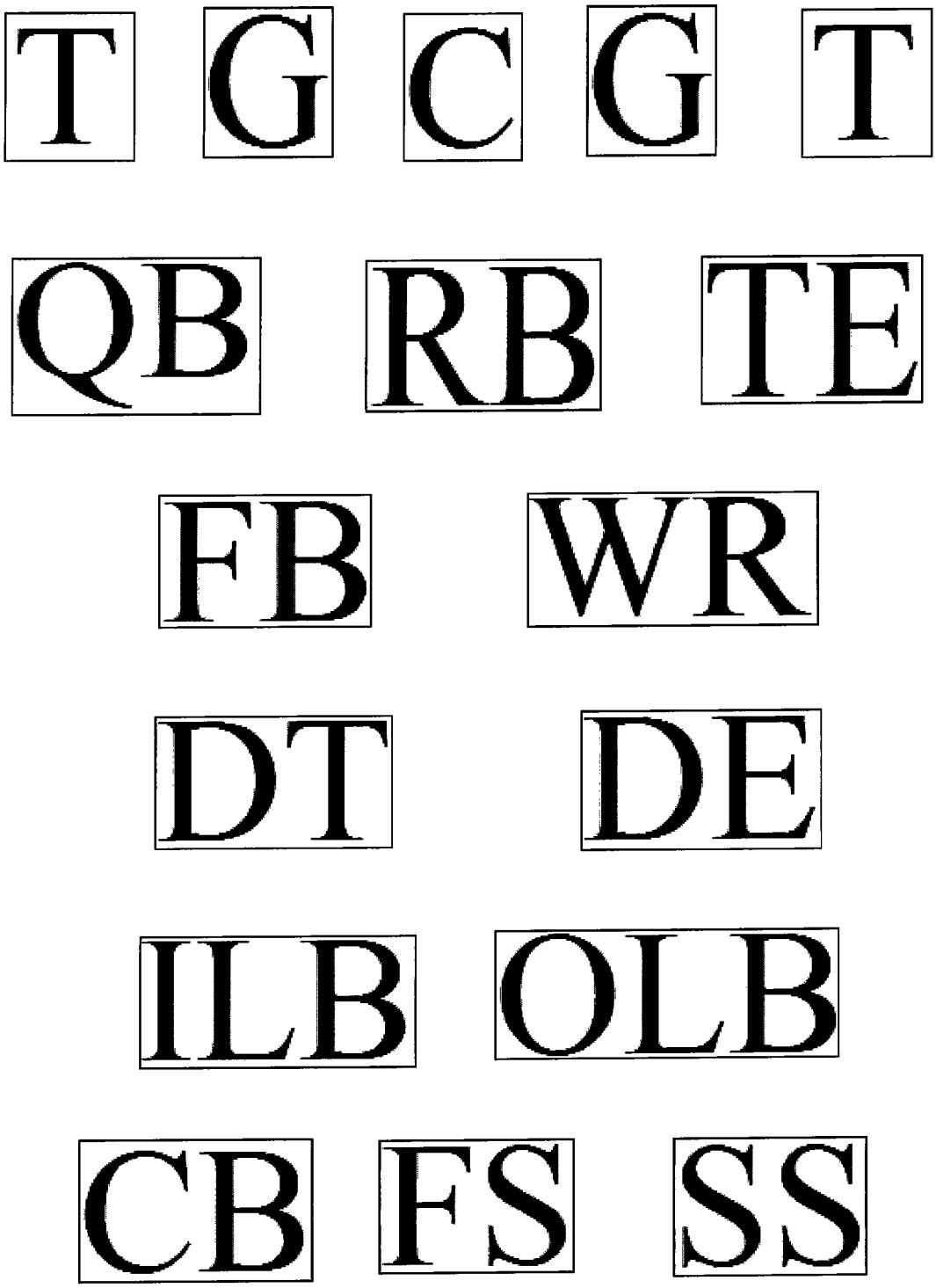
FIG. 3 illustrates exemplary patches worn by players for easy identification of a player's position.

With reference to FIG. 3, there is illustrated a number of position patches, comprising a letter or letters, that may be attached to a player's uniform, for example, on a back or front of a player's jersey or elsewhere, so that teammates and practice competitors can easily identify a player's position. This means of visual identification enables players to more easily recognize expected maneuvers, based on positional responsibilities, of teammates or of practice competitors. As shown, the position patches are examples for identifying football players' positions, however, it will be understood that position identifiers for other sports may also be used. With regard to the exemplary football position identifiers illustrated in FIG. 3, the identifiers represent positions as follows: "T" indicates "tackle"; "G" indicates "guard"; "C" indicates "center"; "QB" indicates "quarterback"; "RB" indicates "running back"; "TE" indicates "tight end"; "FB" indicates "fullback"; "WR" indicates "wide receiver"; "DT" indicates "defensive tackle"; "DE" indicates "defensive end"; "ILB" indicates "inside linebacker"; "OLB" indicates "outside linebacker"; "CB" indicates "cornerback"; "FS" indicates "free safety"; and "SS" indicates "strong safety".

Figure 4:
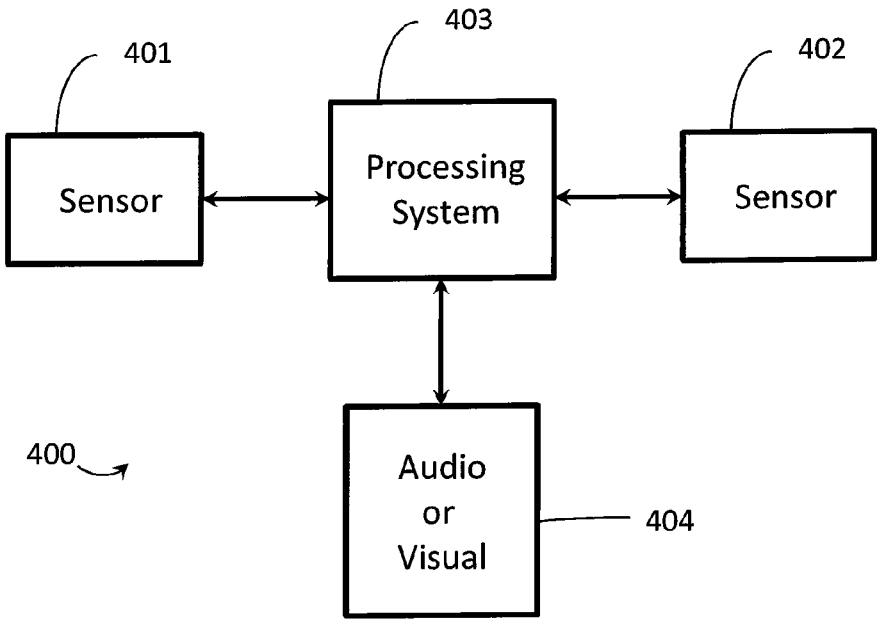
FIG. 4 illustrates a schematic diagram of an exemplary processing circuit used for operating an embodiment of the present invention.

With reference to FIG. 4 there is illustrated a schematic circuit diagram showing pressure sensors 401, 402, electrically connected to processor section 403. The sensors are initially activated by one or more processors in processor section 403, and transmit electric signals to the processor section 403 indicating that at least one of the pressure sensors 401, 402 has detected physical contact. The processor, under appropriate programming, such as a sensitivity setting, outputs an electric signal, in response to the electric signal from the pressure sensor indicating that the physical contact pressure exceeded the sensitivity setting, to an audio or visual output device for triggering a visual or audio output that may include a speaker or LED. The speaker or LED may be connected by wire or wirelessly to the processing unit for receiving the electric signal.

Figure 5:
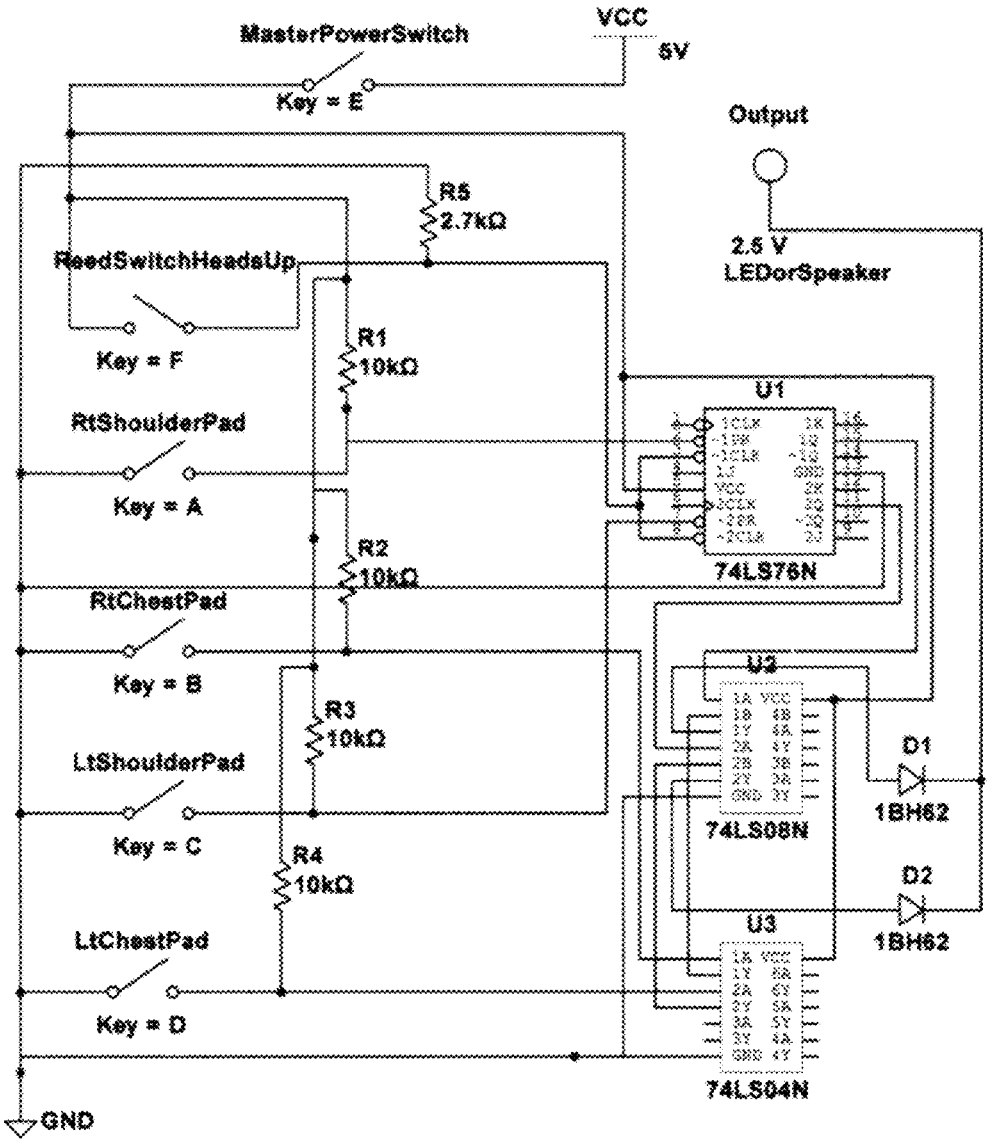
FIG. 5 is a schematic diagram illustrating interoperation of the exemplary electric circuit worn by players.

With reference to FIG. 5, there is illustrated one circuit embodiment of the sensor integrated sports education training system. The circuit comprises several electrical components as follows: Power source Vcc is connected to MasterPowerSwitch (switch E) which, in turn, is connected in parallel to: ReedSwitchHeadsUp (switch F); RtShoulderPad (switch A) and the 1PR pin of circuit chip U1 through resistor R1 of about 10 kΩ; RtChest Pad (switch B) and the 1A pin of circuit chip U3 through resistor R2 of about 10 kΩ; LtShoulderPad (switch C) and the 2PR pin of circuit chip U1 through resistor R3 of about 10 kΩ; LtChestPad (switch D) and the 2A pin of circuit chip U3 through resistor R4 of about 10 kΩ; and to the Vcc (power) inputs of all three circuit chips U1, U2, and U3. Circuit ground GND is directly connected to the other side of switches A, B, C, and D and to the GND pins of the three circuit chips U1, U2, and U3. Circuit ground GND is also connected to switch F, and the 1CLR and 2CLR pins of circuit chip U1, all through resistor R5 of about 2.7 kΩ. An Output of the circuit embodiment of FIG. 5 may comprise an LED or speaker, or a combination thereof, at about 2.5 V, which is connected to pins 1Y and 2Y of circuit chip U2 through diodes D1 and D2, respectively. Finally, the circuit chips are connected as follows: circuit chip U1 pins 1Q and 2Q are connected to circuit chip U2 pins 1A and 2A, respectively; and circuit chip U2 pins 1B and 2B are connected to circuit chip U3 pins 1Y and 2Y, respectively.

Power is provided to the circuit by a battery at about 6 V (Vcc) connected to MasterPowerSwitch (switch E) which may be a toggle switch, a flat push button switch, or other known type of switch, such as a capacitive switch, that may be positioned within reach of the player wearing the protective pads 100 and that, when powered on by the player, allows the circuit to become activated upon the switch ReedSwitchHeadsUp (switch F) closing, which occurs when the player's head is held in an upright position while assuming a stance in preparation for physical contact. This stance, assumed by the athlete, brings sensors 107, 108 into proximity, which sensors may comprise a magnetically activated switch in one of portions 107 or 108 and a magnetized portion in the other, causing the closing of the switch ReedSwitchHeadsUp (switch F) and activating the four sensors. These four sensors include: a right shoulder sensor, "RtShoulderPad" (switch A); an upper right chest area sensor, "RtChestPad" (switch B); a left shoulder sensor, "LtShoulderPad" (switch C); and a left upper chest area sensor, "LtChestPad" (switch D). In one embodiment, after powering on the circuit by closing switch E and after proximity sensors indicate that the helmet is in a proper upright position, which closes switch F, upon switch A or C (right or left shoulder pad) being closed first by detecting a physical contact thereon followed by corresponding switch B or D (right or left chest pad), respectively, being closed next, by detecting a physical contact thereon, an electric signal is transmitted by circuit ship U2 to the Output, thereby activating an audible or visual output that is detectable by the student, the coach, or both. As described above, the Output may be communicatively connected to an audible, visible, or tactile output device, such as attached to equipment worn by the player, or it may be connected to a wireless transmitter which transmits a signal for activating a remote audible, visible, or tactile output device. The signal may also be transmitted to a processing system such as a PC, or other processing device such as a hand held device, to accumulate data for logging impact information related to individual players or as an aggregated database of impact information. As shown in the exemplary circuit, the output device may comprise at least one piezo buzzer, at least one LED, at least one tactile pressure transducer, or a combination thereof. The circuit may be implemented as a small circuit board or module, which may be rigid or flexible, together with other components contained in the sleeve 110 as described above. The MasterPowerSwitch (switch E) may be positioned anywhere within or without the sleeve 110 as shown in FIGS. 1A-1B, or in a customized extension of sleeve 110 wherein a player may reach the switch to close it, thereby powering on the circuit.

Figure 6:
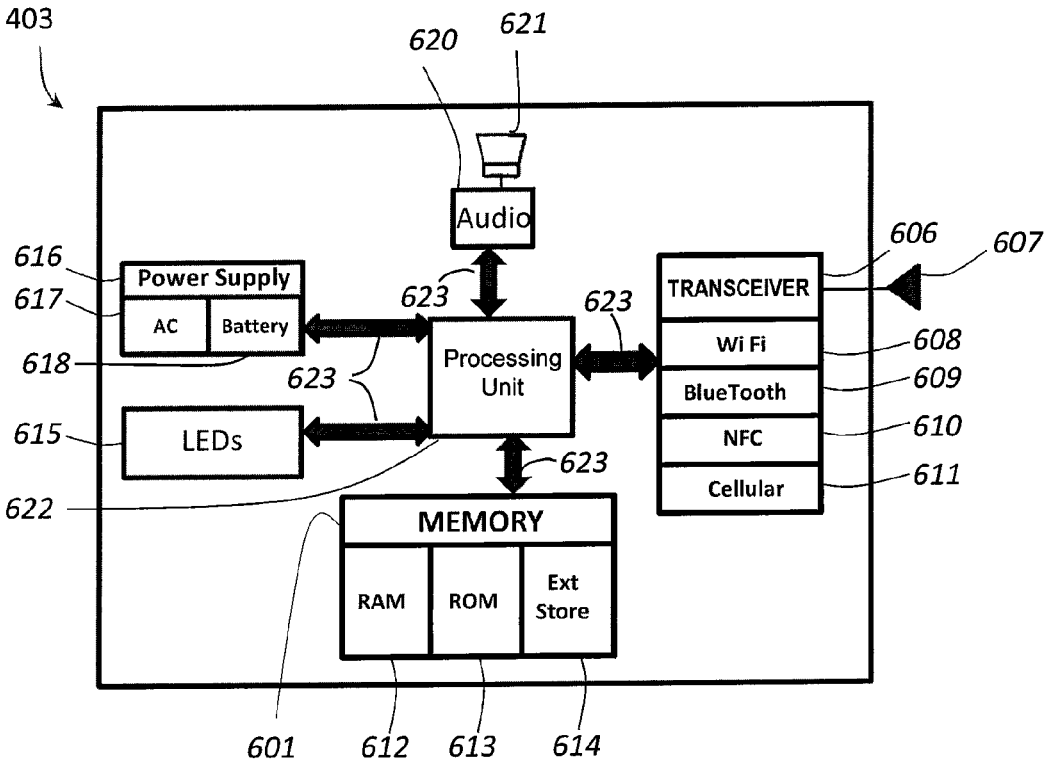
FIG. 6 is a schematic diagram illustrating an exemplary processing system.

FIG. 6 illustrates, in a general schematic format, a processing system for implementing embodiments of the present invention. In general terms, a processing system, or data management unit, 403 may be used for controlling operation of the contact sensors described herein. A memory module 601, that includes but is not limited to volatile random access memory ("RAM") 612, a non-volatile memory 613, which may comprise read only memory ("ROM") or flash memory, and a circuit 614 for connecting to an external portable memory device via a data port, is electrically connected to the processing unit 622 over a communication interface 623. External memory devices may include flash memory devices housed in thumb drives, portable hard disk drives, data cards, or any other form of electronic storage. The on-board memory can include various embedded applications executed by the processing unit 622 for operation of the SISE, as explained herein. On board memory 601 can also be used to store a history of a player's performance and other related data pertaining to a particular player. Using the wireless transmission capability of the processing system 403 as described below, such accumulated data can be transferred via wired or wireless transmission to connected computers or other processing devices. Remote and local storage (or memory) may be used as necessary for storing computer programs and data sufficient for implementing embodiments of the invention as described herein and to execute programs and algorithms disclosed herein. Data stored in memory 601 may also include those provided by the sensors 401, 402 connected to the processing system 403.

Processing system 403, may also include a communication system (transceiver) 606 that in one embodiment may be used to communicate with other sensors or with equipment utilized by coaches such as for receiving and storing contact data detected by sensors connected to processing system 403. Communication system 606 can comprise for example, one or more optical, radio frequency or other transducer circuits or other systems that wirelessly transmit digital data using an optical signal, radio frequency signal or other form of wireless signal. Communication system 606 may be adapted to communicate by way of a communication network or data transfer network such as the interne via Wi-Fi communication circuit 608, Bluetooth communication 609, Near-Field communication 610, or a cellular network 611, or other form of mobile telecommunication network such as wired or wireless local area network or any other conventional wired or wireless data transfer system.

Referring to FIG. 6 in more detail, there is illustrated, in simplified schematic form, electronic components of the processing system 403 that may be disposed on, for example, a printed circuit board situated within the sleeve 110, described above, or on a piece of training equipment. The processing system 403 includes a processing unit 622 in the form of a microprocessor, a microcontroller, an application specific integrated circuit ("ASIC"), a mixed signal processor ("MSP"), a field programmable gate array ("FPGA"), or a combination thereof, and is electrically connected to various electronic modules included on, or connected to, the printed circuit board, as will be described below. The processing unit 622 is electrically connected to, for example, a communication circuit, or transceiver, 606. The processing unit 622 can be configured to receive input from the transceiver 606 and may also execute instructions with respect to such received inputs.

An LED module 615 is electrically connected to the processing unit 622 over the communication interface 623 for receiving and displaying output data, for example, lighting a particular color LED in response to an output signal received from processing unit 622 indicating that a detected contact that was correctly or incorrectly performed. Color or brightness of the LED output may also be controlled by the processing unit 622 via the light source control module 615. An audio module 620 includes a speaker 621 for outputting audio under control of the processing unit 622. Audio outputs can include, for example, preprogrammed tones and notifications, such as in the form of monotone outputs or in another form which may be recorded and stored in local memory 601. Such stored audio data can be accessed by processing unit 622 and executed as playback data at appropriate times. The processing unit 622 may have electrical access to a digital time-of-day clock connected to the printed circuit board for recording dates and times of detected contacts, which may then be accessed, stored, and/or uploaded at a later time as necessary.

A wireless module 606 may include transceiver circuits for wireless digital data transmission and reception via one or more internal digital antennas 607, and is electrically connected to the processing unit 622 over communication interface 623. The wireless transceiver circuits may be in the form of integrated circuit chips, chipsets, programmable functions operable via processing unit 622, or a combination thereof. Each of the wireless transceiver circuits is compatible with a different wireless transmission standard. For example, a wireless transceiver circuit 608 may be compatible with the Wireless Local Area Network IEEE 802.11 standard known as WiFi. Transceiver circuit 608 may be configured to detect a WiFi access point in proximity to the processing system 403 and to transmit and receive data from such a detected WiFi access point. A wireless transceiver circuit 609 may be compatible with the Bluetooth protocol and is configured to detect and process data transmitted from a Bluetooth "beacon" in proximity to the processing system 403. A wireless transceiver circuit 610 may be compatible with the near field communication ("NFC") standard and is configured to establish radio communication with, for example, an NFC compliant processing system in proximity to the processing system 403. A wireless transceiver circuit 611 may comprise a circuit for cellular communication with cellular networks and is configured to detect and link to available cellular communication towers.

A power supply module 616 is electrically connected to all modules in the processing system 403 and to the processing unit 622 to supply electric power thereto. The power supply module 616 may comprise standard or rechargeable batteries 618 that are charged when the processing system 403 is connected to a source of AC power. The power supply module 616 is also electrically connected to processing unit 622 over the communication interface 623 such that processing unit 622 can monitor a power level remaining in a battery power mode of the power supply module 616.

In addition to connecting external storage for use by the processing system 403, the external memory device 614 interface may be used to accept a suitable connector, thereby allowing the processing system 403 to be wired to an external device such as a personal computer. The external storage 614 port can be any port that allows for transmission of data such as, for example, a serial, USB, or a parallel port.

Figures 7, 8:
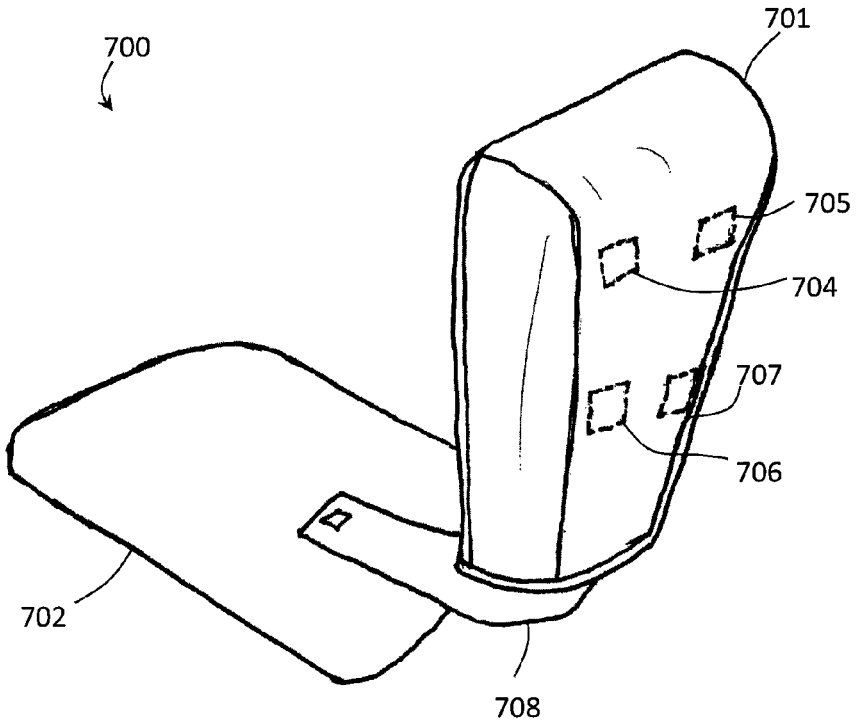
FIG. 7 illustrates an exemplary piece of athletic equipment comprising sensors for detecting contact as described herein.
FIG. 8 illustrates an exemplary data structure that may be used for accumulating data obtained by the sensor integrated sports education system.

With reference to FIG. 7, there is illustrated an exemplary embodiment of a piece of practice equipment in the form of a tackling dummy 700 that is commonly used during practice and training for football. The tackling dummy 700 comprises a padded portion 701 upon which a football player practices blocking and/or tackling by impacting the padded portion 701 with the player's pads, for example, the player's shoulder pads such as illustrated in FIGS. 1A-1B. A helmet worn by the player, if any, may make incidental or intentional contact with the padded portion 701 during such practice sessions. A support 708 is a semi-rigid component typically made of a semi-flexible metal that is attached to the padded portion 701, to secure it in an upright position, and to a base portion 702 which comprises sufficient weight to stabilize the upright position of the tackling dummy 700. Typically, the support 708 is capable of being deflected during a player's impact with the padded portion 701 while still remaining attached to both the padded portion 701 and the base 702. The base portion 702 is designed to provide a balanced base for the support 708 and the padded portion 701 with sufficient weight so as to provide resistance to a player's impacting the padded portion 701. With sufficient force, a player may be able to move the tackling dummy 700 along a practice field. A heavier tackling dummy 700 will provide greater resistance to movement along a practice field which may be desired for increasing a player's blocking and tackling strength. Sensors 704-707, substantially similar in operation as described herein with respect to sensors 101-104, are placed at selected locations on the padded portion 701. The sensors 704-707 may be attached temporarily, such as by hook and loop fasteners, or permanently to the padded portion 701. The sensors 704-707 are each connected to a processor, such as described above with reference to FIG. 2, which may be located together with one or more of the sensors 704-707 or attached elsewhere on the tackling dummy 700. The sensors 704-707 may be placed at locations on the tackling dummy 700 indicating correct contact points or they may be placed at locations on the tackling dummy that indicate incorrect contact points. The audible or visual outputs provided by the sensors 704-707 upon detecting contact will correspondingly indicate to a player or trainer a correct or incorrect impact upon the padded portion 701. Similar in operation to the sensors attached to a player's equipment, or other garment, as described herein, the sensors transmit an indication to the processor that a pressure contact was detected, whereupon the signal may be processed and stored as described herein. Such signals may be recorded or stored as performance data for later use or as immediate feedback for the player and/or the coach.

With reference to FIG. 8, there is illustrated an exemplary data structure, such as a table, that may be used for storing recent or lifetime training data associated with particular players, coaches, time periods, or any other category that may be tracked using embodiments disclosed herein. The table may include entries for several, hundreds, or thousands of players. As shown in the table, example categories of contact data that may be manually entered for tracking and storage purposes include a player identification 801, such as a player's name; a period of time 802 during which the data are collected, which time period can be identified by, for example, "Pop Warner", "High School", or by a range using a day/month/year format, and may include time-of-day information; a coach identification 803, such as a coach's name; injury information, which information may be entered, for example, by a coach using a device at, or remote from, the processing system 403, such as a PC; a contacts detected total 805, which contact data may be transmitted to a PC by the processing system 403 together with a contacts correct total 806 indicating the number of the detected contacts that were performed properly by the named player. Performance percentage 807 may reflect a calculated percentage of correctly performed contact exercises executed by a player as determined based on the number in the contacts detected column 805 and on the correctly performed total 806; and a player's position 808 such as "quarterback". Various other metrics may be included in the exemplary table of FIG. 8 to enable a statistical analysis of various factors that may contribute to a player's performance results.

Those skilled in the art will appreciate that various circuit operations may be implemented using embodiments described herein. For example, the sequential activation of sensors as described above may be replaced with a circuit containing sensors that are always in an active state and transmit electric signals indicating detected impacts without regard to a prior activation step.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.), or an embodiment combining software and hardware aspects that may all generally be referred to herein as a "service," "circuit," "circuitry," "module," and/or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Program code and/or executable instructions embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer (device), partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a first sensor disposed in a first location of athletic equipment worn by a player;

a second sensor, capable of detecting proximity of the first sensor, disposed in a second location of the athletic equipment worn by the player; and at least a third sensor, capable of detecting contact, disposed in a selected location of the athletic equipment worn by the player, wherein the at least third sensor is configured to be activated by proximity of the first sensor to the second sensor.

2. The system of claim 1, the system is configured to detect a proper body position of the player during the contact.

3. The system of claim 2, wherein the proper body position comprises a head up body position.

4. The system of claim 1, wherein the selected location is on a shoulder pad of the athletic equipment.

5. The system of claim 1, wherein the athletic equipment is a jersey, a garment, a uniform, pants, padding, or a combination thereof.

6. The system of claim 1, wherein the athletic equipment is protective equipment, such as a shoulder pad, a hip pad, a shin pad, an elbow pad, a thigh pad, a knee pad, a helmet, a visor, a glove, or a combination thereof.

7. The system of claim 1, further comprising an output device for outputting a signal in response to the contact detected by the third sensor, wherein the output device is an acoustic output device, an illuminating output device, a pressure inducing device having a moveable tactile component capable of being felt by the player, or a combination thereof.

8. The system of claim 7, further comprising an electronic memory for storing information for identifying the player and for storing information related to a number of contacts detected by the at least third sensor disposed in the athletic equipment worn by the player.

9. The system of claim 7, wherein the output device is disposed in a second selected location on the athletic equipment worn by the player such that the player is able to hear the signal if the output device comprises an acoustic output device, or the player is able to see the signal if the output device comprises a light source, or the player is able to feel the signal if the output device comprises a pressure inducing output device, or a combination thereof.

10. The system of claim 7, wherein the output device is disposed proximate to a player's instructor such that the instructor is able to hear the signal if the output device is an acoustic output device, or the instructor is able to see the signal if the output device comprises a light source.

11. The system of claim 7, wherein the output device is electrically connected to a processing system for storing detected contact data.

12. A system comprising:

a first sensor disposed in a first location of athletic equipment worn by a player;

a second sensor, capable of detecting proximity of the first sensor, disposed in a second location of the athletic equipment worn by the player; and at least a third sensor, capable of detecting contact, disposed in a selected location of the athletic equipment worn by the player, a processor communicating with the first, second, and at least third sensors for receiving electric signals from the sensors and for controlling operation of the sensors, the processor disposed in a second selected location of the athletic equipment; and an output device coupled to the processor for outputting a human detectable signal in response to contact sensed by the at least third sensor, wherein the at least third sensor is configured to be activated by proximity of the first sensor to the second sensor.

13. The system of claim 12, further comprising an electronic memory for storing information for identifying the at least one player and for storing information related to a number of contacts sensed by the sensors disposed in the athletic equipment worn by the at least one player.

14. The system of claim 13, wherein the output device is disposed proximate to a coach of the player such that the coach is able to hear the signal if the output device is an acoustic output device, or the coach is able to see the signal if the output device comprises a light source.

15. The system of claim 12, wherein the output device is connected to a processing system for storing detected contact data, and wherein the processor communicates with the output device wirelessly.

* * * * *